US007117924B2

(12) United States Patent
Hunter

(10) Patent No.: US 7,117,924 B2
(45) Date of Patent: Oct. 10, 2006

(54) SQUEEZE STATION FOR AUTOMATED MOLDING MACHINE

(75) Inventor: William A. Hunter, Naples, FL (US)

(73) Assignee: Hunter Automated Machinery, Schaumburg, IL (US)

( * ) Notice: Subject to any disclaimer, the term of this patent is extended or adjusted under 35 U.S.C. 154(b) by 0 days.

(21) Appl. No.: 11/005,642

(22) Filed: Dec. 6, 2004

(65) Prior Publication Data

US 2006/0118267 A1 Jun. 8, 2006

(51) Int. Cl.
*B22C 15/00* (2006.01)

(52) U.S. Cl. ..... 164/169; 164/388; 164/385; 164/386; 164/187

(58) Field of Classification Search ..... 164/169, 164/388, 385, 386, 187
See application file for complete search history.

(56) References Cited

U.S. PATENT DOCUMENTS 3,303,536 A * 2/1967 Pegon ..... 164/137
3,406,735 A 10/1968 Hunter
3,506,058 A 4/1970 Hunter
4,553,581 A * 11/1985 Uppgren et al. ..... 164/16
4,657,064 A * 4/1987 Hunter ..... 164/169
4,699,199 A 10/1987 Hunter
4,836,266 A * 6/1989 Wuepper et al. ..... 164/29
4,840,218 A 6/1989 Hunter
4,890,664 A 1/1990 Hunter
6,622,772 B1 9/2003 Hunter

OTHER PUBLICATIONS

Hunter Automated Machinery Corporation; Internet; G & H Series Molding Machines; www.hunterauto.com; Date Last Visited Nov. 5, 2004; four pages.

* cited by examiner

*Primary Examiner*—Kevin Kerns
*Assistant Examiner*—I.-H. Lin
(74) *Attorney, Agent, or Firm*—Leydig, Voit & Mayer, Ltd.

(57) ABSTRACT

An automated matchplate molding machine includes a cope flask, a pattern plate and a drag flask for creating formed sand molds. A lock is provided to lock the drag flask to the platen table of the molding machine during desired stages of an individual sand molding sequence. The lock between the drag flask and the platen table may include actuated pins which engage corresponding detent structures such as tapered holes integral with the drag flask and prevent lateral migration of the drag flask relative to the platen table. Additionally, cope flask actuators are provided which vertically support and are operable to raise the cope flask relative to the squeeze head to facilitate release the cope mold from the cope flask.

14 Claims, 12 Drawing Sheets

SQUEEZE STATION FOR AUTOMATED MOLDING MACHINE

FIELD OF THE INVENTION

The present invention generally relates to automated matchplate molding machines for forming sand molds for use in foundries, and more particularly relates to apparatus in such mold making equipment for stabilizing drag flasks and/or apparatus for facilitating release of cope molds from cope flasks according to different aspects of the invention.

BACKGROUND OF THE INVENTION

Foundries use automated matchplate molding machines for forming sand molds. Formed sand molds are subsequently filled with molten metal material, cooled, and then broken apart to release metal castings. There are several prior art systems for this purpose including several prior art systems assigned to the present Assignee, Hunter Automated Machinery Corporation, including U.S. Pat. No. 3,406,738 to Hunter; U.S. Pat. No. 3,506,058 to Hunter; U.S. Pat. No. 4,890,664 to Hunter; U.S. Pat. No. 4,699,199 to Hunter; U.S. Pat. No. 4,840,218 to Hunter; and U.S. Pat. No. 6,622,722 to Hunter. The entire disclosures of these patent references are hereby incorporated by reference as the present invention may be incorporated or used in these types of molding systems. Additional reference can be had to these patent references for additional details of the state of the art and to see potential applicability of the present invention. While the foregoing inventions have set forth significant advances and advanced the state-of-art to increase the speed and efficiency in which automated sand molding can occur, there is still further room for improvement in automated molding machinery which is the subject of the present invention.

BRIEF SUMMARY OF THE INVENTION

A first aspect of the present invention is directed toward a releasable lock for preventing relative lateral movement between the platen table and a drag flask during squeezing and compression of sand contained in the cope and drag flasks. Such a lock mechanism minimizes the potential for misalignment of formed cope and drag molds which could be caused by relative lateral movement or wandering of the drag flask due to machine vibrations or other such causes. According to this aspect of the invention, a molding machine includes a cope flask for making cope molds, a drag flask for making drag molds and a pattern plate that is positioned between the cope flask and the drag flask when in a squeeze position. The molding machine also includes a squeeze head that is received into an open end of the cope flask in the squeeze position (with the cope flask extending generally between the squeeze head and the pattern plate), and a platen table that is received in an open end of the drag flask in the squeeze position (with the drag flask extending generally between the platen table and the pattern plate). In accordance with this aspect of the invention, the molding machine also includes a lock between the platen table and the drag flask which prevents relative lateral movement between the platen table and the drag flask in the squeeze position.

In this regard, a further aspect of the present invention is that the lock may comprise at least one and preferably two or more actuators in spaced lateral relation and mounted to the platen table, and corresponding structures integral with the drag flask. Each actuator includes a pin (which may be the shaft of a fluid powered cylinder) that is linearly moveable into engagement and out of engagement with a corresponding one of the detent structures, to thereby provide the lock during the squeeze position. Each detent structure may comprise a hole and preferably a tapered blind hole. Further preferred characteristics and settings are further described and claimed herein.

According to a different aspect of the present invention, a new way to release a cope mold from the cope flask is disclosed. This aspect generally includes an actuator mounted to the cope flask which drives the cope flask relative to the squeeze head. According to this aspect of the present invention, a molding machine for forming cope molds and drag molds from sands comprises a support frame, a cope flask for making cope molds, a drag flask for making drag molds and a pattern plate that is adapted to be positioned between the cope flask and the drag flask for forming patterned cavities in the cope and drag molds. The squeeze head is received into an open end of the cope flask in a cope mold release mode of the machine. At least one actuator is mounted to the cope flask and to the support frame. The actuator is expandible and retractable to drive the cope flask relative to the squeeze head to thereby facilitate release of the cope mold.

Other aspects, objectives and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
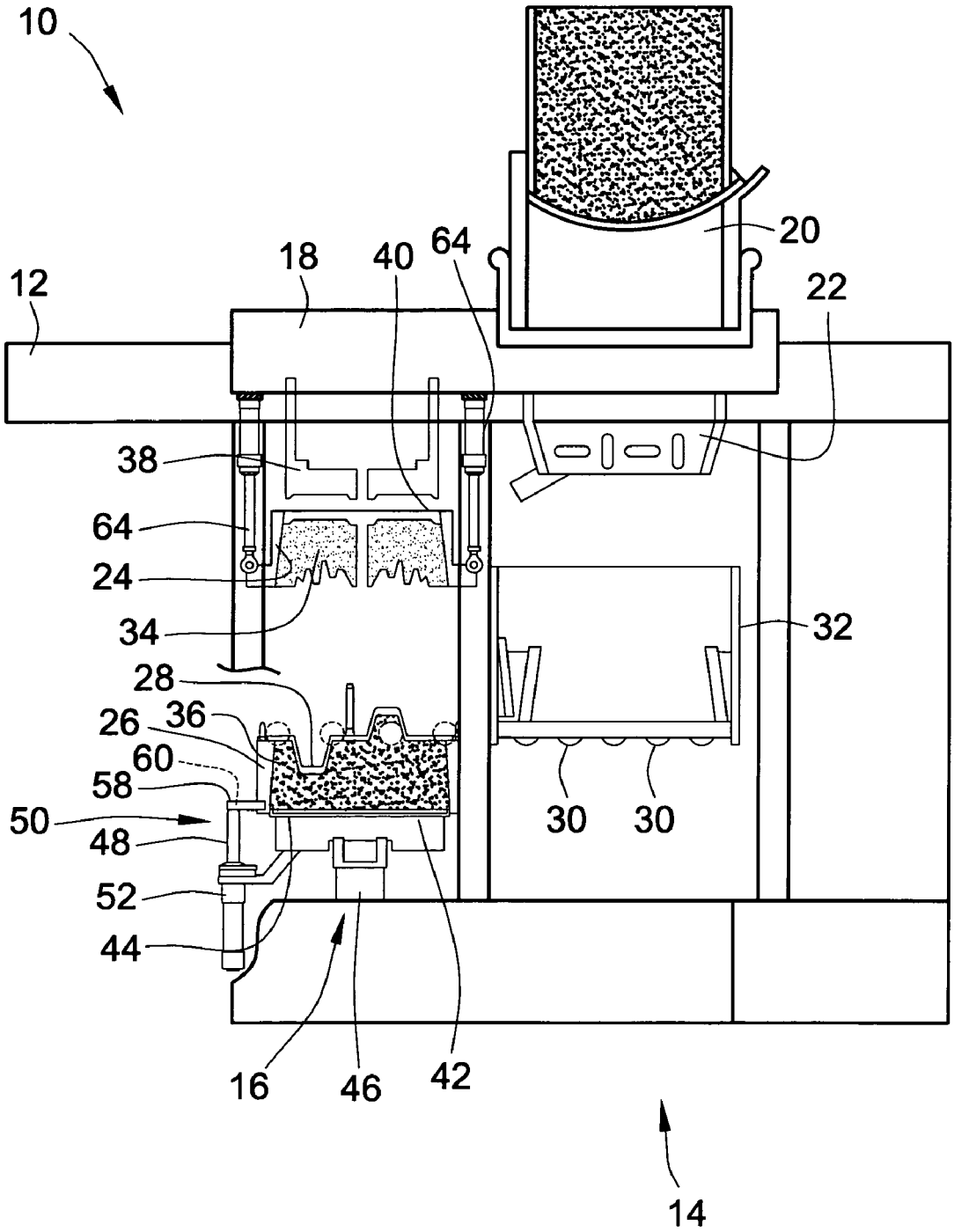
FIG. 1 is a partly schematic elevational representation of a molding machine illustrating an embodiment of the present invention and an example of an environment in which the present invention may be implemented.

Turning to FIG. 1, an example of an embodiment of an automatic matchplate molding machine 10 is illustrated in schematic form. With the exception of the inventive improvements as discussed herein, the machine illustrated is similar to the HMP type molding machines that are manufactured and commercially available from Hunter Automated Machinery Corporation, the present assignee of the instant patent application. Machines of these types are well known to those of ordinary skill in the art and are widely used throughout the foundry industry. In view of the fact that many of the details of different types of HMP machines or other such machines are known and also shown generally in the aforementioned patents which have been incorporated by reference, discussion of the general operation of the machine will thus be limited and particular focus will be given to the particular inventive improvements to the machine 10 which are discussed and claimed herein.

As shown in FIG. 1, the molding machine 10 includes a support frame 12. Different sections of the support frame 12 provide for different work stations including a drag flask filling station 14 and a mold squeeze and release station 16. The molding machine 10 includes a movable hopper car 18 which includes a sand hopper 20 that is filled with sand. The sand hopper 20 has an openable and closable discharge port 22 which is adapted to align with and discharge sand separately into a cope flask 24 and a drag flask 26. The hopper car 18 linearly reciprocates horizontally along a top portion of the support frame 12. The hopper car 18 automatically shifts back and forth between the mold squeeze and release station 16 and the drag flask filling station 14. This alternately and successively positions the sand hopper 20 at the mold squeeze and release station 16 to fill the cope flask and the drag flask filling station 14 to fill the drag flask. The cope flask 24 is always situated at the mold squeeze and release station 16 during all successive molding operations of the machine 10, while the drag flask 26 (and pattern plate 28 which is typically secured thereto) is carted back and forth between the two stations 14, 16. To facilitate the horizontal cycling back and forth between the two stations, rollers 30 are provided upon which the drag flask 26 is adapted to ride and roll between the two stations.

At the drag flask filling station 14, the drag flask is received in a rollover cradle 32 that flips the drag flask upside down such that the open end 44 of the drag flask 26 faces the discharge port 22 of the sand hopper 20 allowing the drag flask 26 to be filled with sand. After the drag flask is filled with sand it can then be turned over again by the rollover cradle 32 to an upright position and then shifted to the mold squeeze and release station 16, where it is assembled with the cope flask that is then filled with sand, squeezed and then disassembled to release the formed cope and drag molds 34, 36. Formed molds 34, 36 are then output to downstream mold handling equipment for receipt of molten metal to produce metal castings.

The mold squeeze and release station 16 includes several relatively conventional components including a squeeze head 38 that is adapted to be received in an open end 40 of the cope flask and a platen table 42 which is adapted to be received in the open end 44 of a drag flask 44. As shown, the squeeze head 38 and platen table 42 are arranged in opposition relative to each other with sufficient space provided therebetween to receive the mold flask assembly for the formation of sand molds. Preferably the plunging axis is vertically aligned as shown, with the platen table 42 located vertically underneath the squeeze head 38. The platen table 42 is actuated by a platen hydraulic cylinder 46 which is operable to raise and lower the platen table 42. The hydraulic cylinder 46 is also operable to squeeze the cope and drag molds 34, 36 contained in the cope and drag flasks 24, 26 when the flask assembly is assembled to form and compress the cope and drag molds 34, 36. The hydraulic cylinder 46 is also operable to locate the platen table 42 at different elevations to facilitate release of the drag mold 36 and assemblage of the formed drag mold 36 with the cope mold 34 which is shown in greater detail in the remaining patent illustrations.

In accordance with one aspect of the present invention, a lock is provided for selectively locking the platen table 42 to the drag flask 26 to prevent relative lateral movement relative to the actuation/plunging axis during mold squeeze operations. Although the lock may take different forms, a preferred embodiment of the lock comprises at least one pin 48 and at least one corresponding detent 50. According to a preferred implementation as shown, the pin 48 is the shaft of a pneumatic cylinder 52. The barrel 54 of the pneumatic cylinder 52 is mounted to the platen table 42 by way of a mounting bracket 56. Although one pneumatic cylinder may be provided, preferably two pneumatic cylinders 52 with separate pins 48 are provided in side by side relation. This structure may be provided along the same outlet end of the molding machine 10 which is why only one cylinder 52 and pin 48 is depicted in FIG. 1 since the other one is hidden behind the illustrated one. Alternatively, this structure can also be arranged as illustrated in the remaining illustrations of the present patent application or otherwise in an operable configuration.

The detent 50 may be integral with the drag flask 26 as shown, and may be provided by a separate detent block 58 that is mounted rigidly to the drag flask 26. In this embodiment the detents 50 are provided by holes which may either be through holes or more preferably tapered blind holes 60 which align with corresponding tapered ends 62 of the cylinder shaft/pins 48.

Each pneumatic cylinder 52 is operable via fluid pressure to extend or retract its shaft/pin 48 above and below the top surface of the platen table 42. This allows formed sand molds to be slid off an output from the molding machine 10 for interference prevention purposes. Each pneumatic cylinder 52 also is set with appropriate pressure relief or a permissible compression such that a maximum force of the cylinders is sufficiently less than the gravitational weight of the drag flask 26 to prevent the drag flask from being lifted off the platen table 42. In this manner the pneumatic cylinder acts as an air spring to provide a resilient positioning of the pin. Alternative resilient means such as a mechanical spring may be substituted for this feature and function.

Turning to another aspect of the present invention, it is seen that the cope flask is vertically supported by hydraulic or pneumatic cylinders 64. Preferably, two or more pneumatic cylinders 64 are provided and are provided on opposite sides of the cope flask 24 for balancing purposes. One end of each cylinder 64 is mounted to the support frame 12 and extends vertically downward with a second end that vertically supports the cope flask 24. To mount the second end of each cylinder 64 to the cope flask 24, a mounting bracket 66 is provided. The mounting bracket 66 is rigidly mounted to the cope flask 24 and has a pivotable connection to the end of the shaft of the cylinder 64. The cope flask 24 is independently actuated separate from the platen table 42 and thus the fluid powered cylinders 64 are operable to lift the cope flask 24 vertically relative to the squeeze head 38 to facilitate release of the cope mold 34, while the closed mold is meld form against the squeeze head 38.

With a general understanding of an embodiment of the invention, attention will be given to potential operational characteristics for an embodiment of the present invention, with reference to FIGS. 2–12. These figures show different time periods or stages during a mold cycle and are numbered in chronological sequence.

Figure 2:
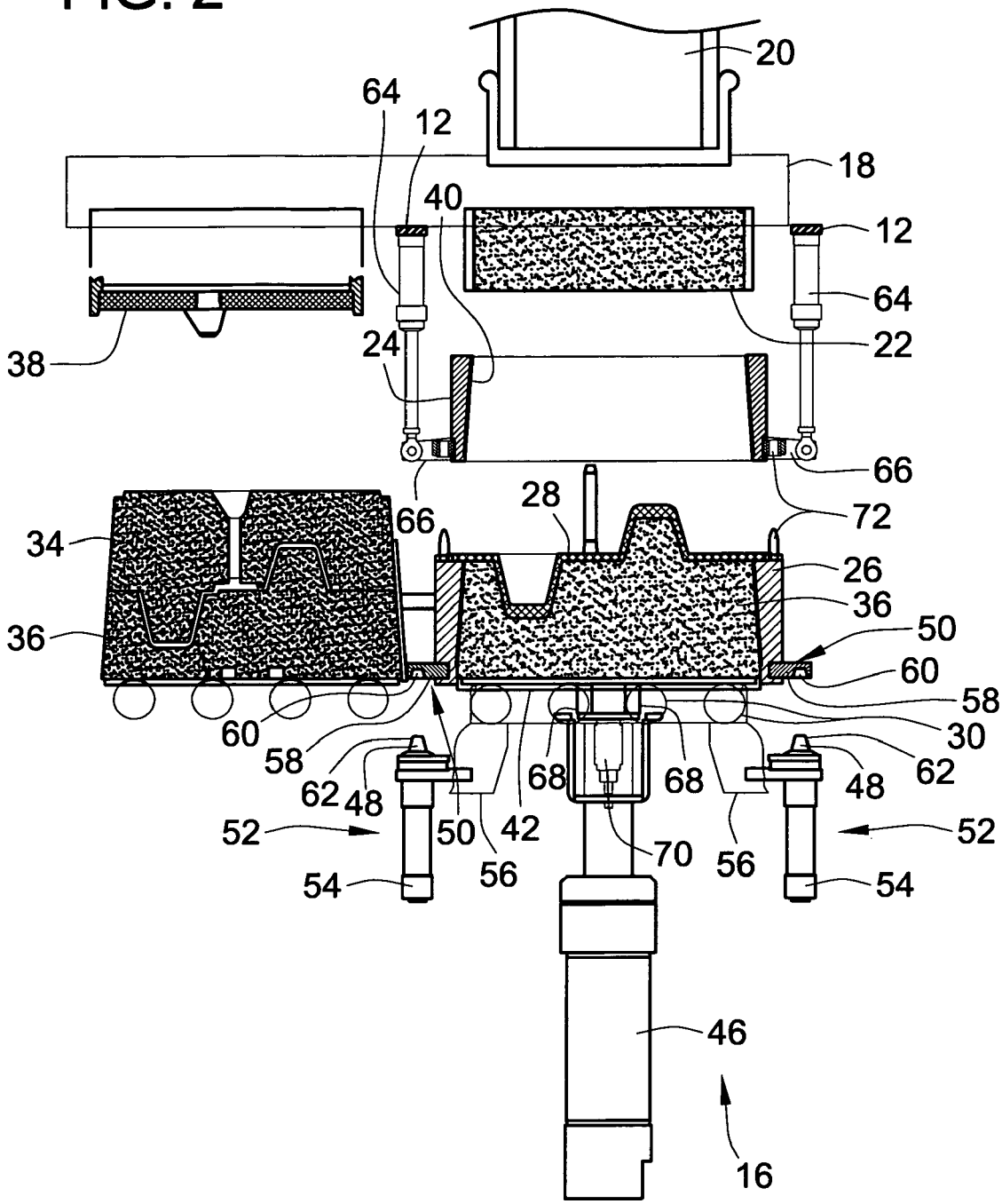
FIGS. 2–12 are partly schematic side elevational views of relative components of such a molding machine shown in FIG. 1, including the squeeze and sand mold release station of the molding machine shown in FIG. 1 (with adjacent stations being shown in some of the figures), and in which each figure shows in sequence different time periods during an operational cycle of such a molding machine to facilitate formation and release of sand molds.

Turning then to FIG. 2, this illustration shows a point in time during an individual sand mold molding cycle at which a drag flask 26 has been filled with sand (which was previously done at the drag flask and filling station 14 shown in FIG. 1). The drag flask 26 is situated on top of the platen table 42 with the previous mold being output off the molding machine for later processing. As also shown, the cope flask 24 is spaced vertically above the drag flask in substantial alignment. The cope flask 24 in this position is vertically elevated by the two pneumatic cylinders 64 and thus is supported through the top of the support frame 12. Also in this position, the hopper car 18 is shown at an out position in which the squeeze head 38 is displaced from the mold squeeze release and release station 16, and in which the discharge port 22 of the sand hopper 20 is aligned with the open end 40 of the cope flask 24. In this position, the lock may be released (but ready to be engaged) with the pins 48 of the respective pneumatic cylinders 52 retracted below the top surface of the platen table 42.

Figure 3:
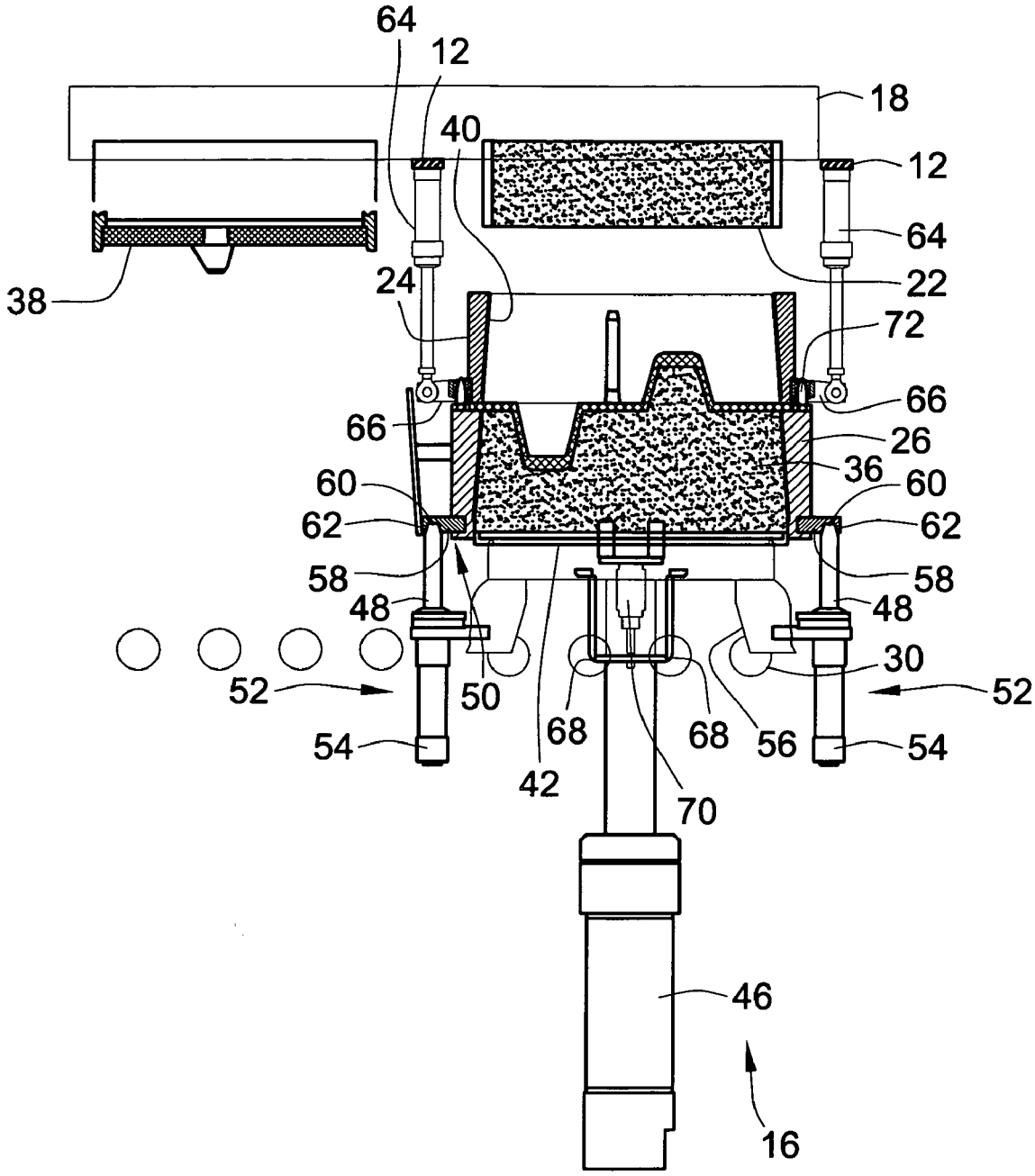

Moving the process forward and turning to FIG. 3 then, the pneumatic cylinders 52 drive their respective locking pins 48 into engagement with corresponding tapered blind holes 60 formed into the detent block 58. This locks the drag flask 26 to the platen table 42 and prevents the drag flask 26 from migrating or wandering horizontally relative to the platen table 42. This better ensures and maintains proper alignment throughout the entire mold compression and forming cycle. Also as shown in FIG. 3, mold lock pins 68 have been actuated by a suitable actuator to project above the top surface of the platen table and project into the internal cavity and sand contained within the drag flask 26. At the same time as these things are occurring, the platen hydraulic cylinder 46 is raising and has raised the drag flask 26 and the pattern plate 28 carried thereby into engagement with the cope flask 24 with alignment being facilitated by suitable pin and hole alignment mechanisms. It should also be noted that the platen hydraulic cylinder 46 is more powerful than the cope flask cylinders 64 and thus can overcome the power of the cope flask cylinders to drive the entire mold flask assembly vertically upward. Suitable pressure relief valves or other pneumatic controls may be provided to set the maximum biasing force that may be exerted by the cope flask cylinders 64 or alternatively the compressive nature of pneumatic fluid may be used to facilitate this feature.

Figure 4:
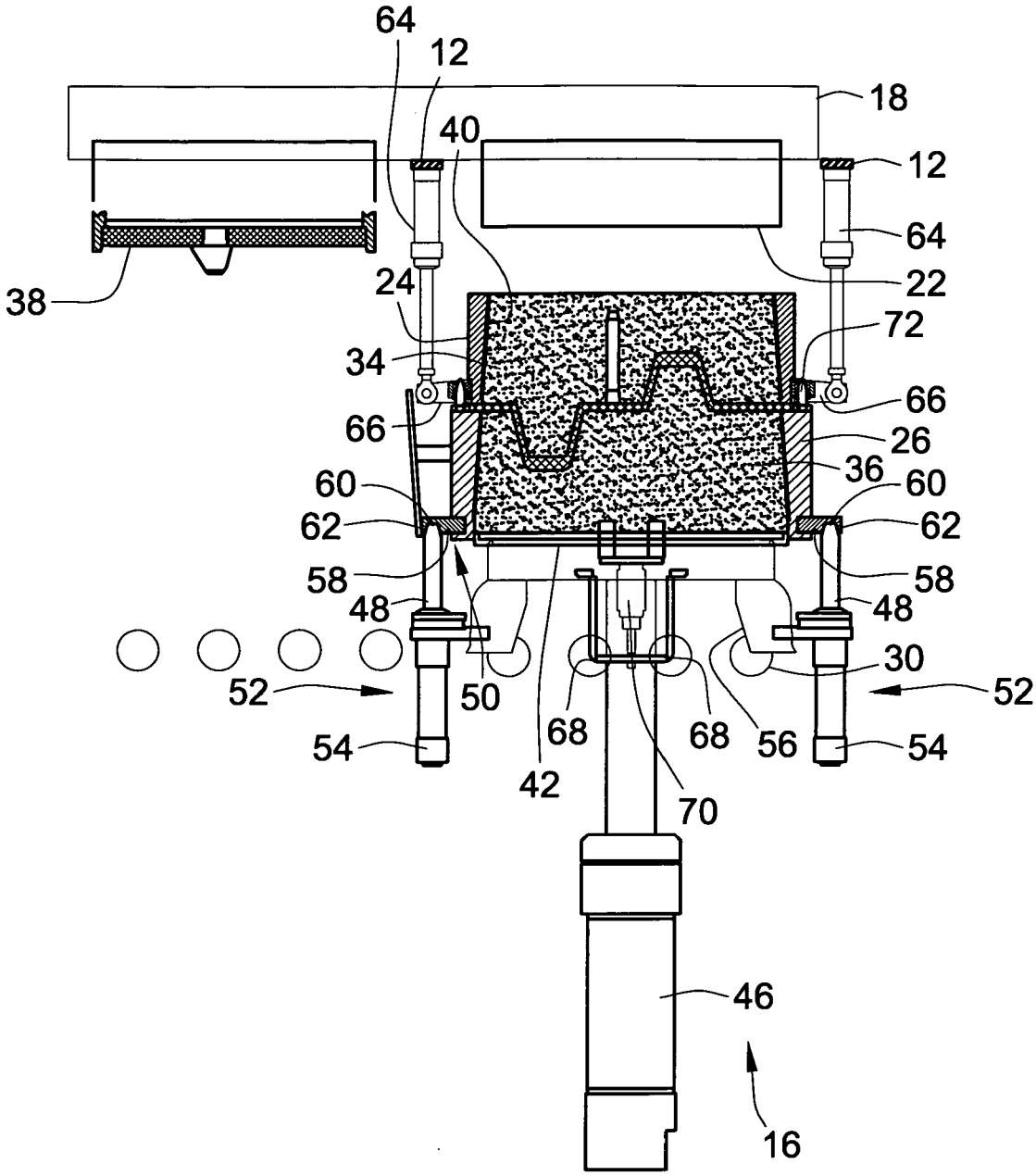

Turning to FIG. 4, showing a subsequent stage in the cycle, sand has now been dumped into the cope flask 24 and over the top side of the pattern plate 28. At this point the sand contained in the cope and drag flasks 24, 26 comprise loose uncompressed sand which make up and take the general outline for the cope mold 34 and drag mold 36.

Figure 5:
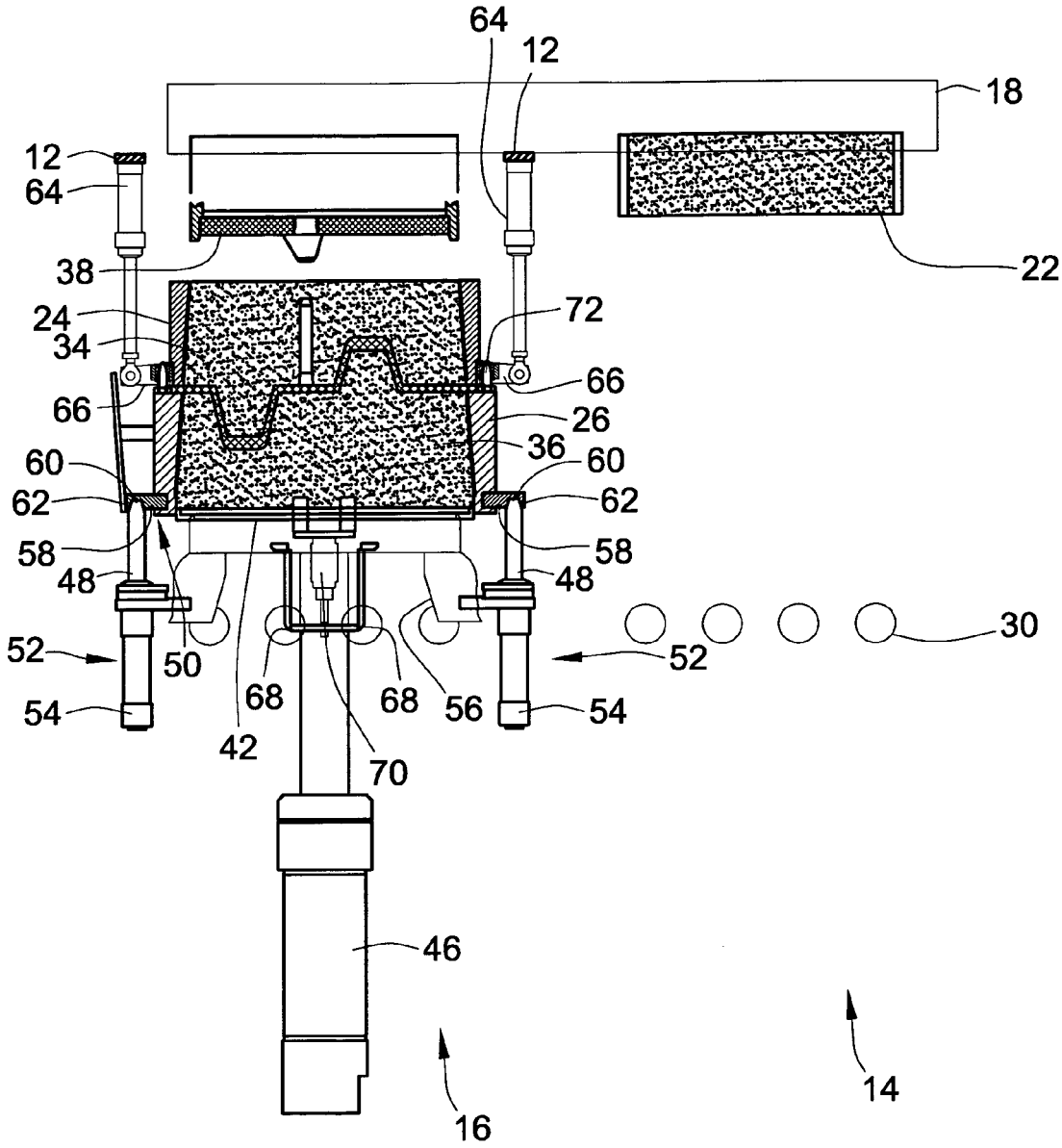
Figure 6:
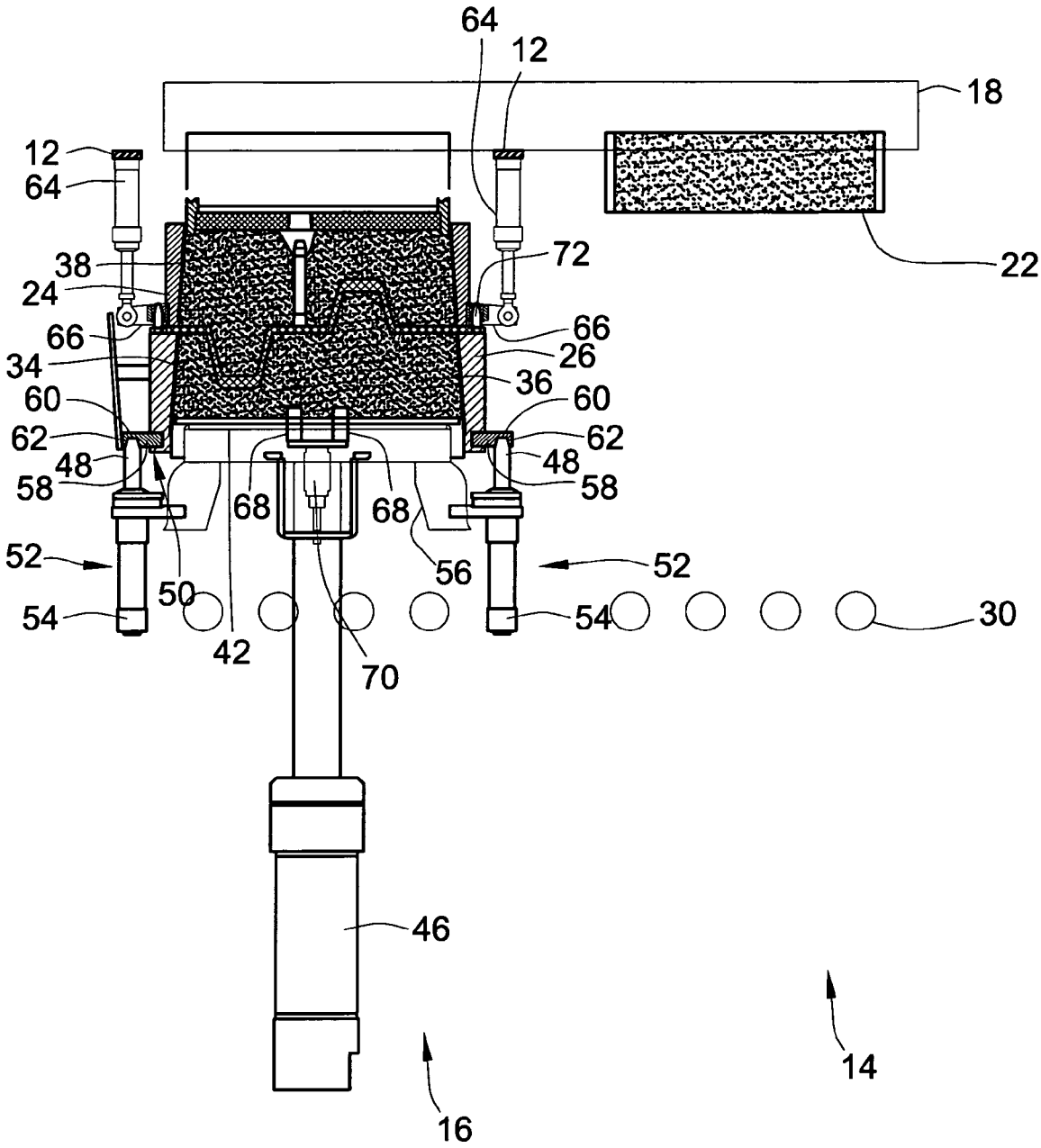

Turning to FIG. 5, showing a further subsequent stage, the hopper car 18 is shifted back inward to align the squeeze head 38 over the cope flask 24 and cope mold 34. Moving further along, FIG. 6 shows the platen hydraulic cylinder 46 facilitating squeezing of the sand material contained in the cope and drag flasks 24, 26 with the squeeze head 38 being received into the top open end 40 of the cope flask in the platen table 42 projecting vertically up into the bottom open end of the drag flask 44. The platen table 42 works against the squeeze head 38 to compress the loose sand material and form the sand material into the desired formed shapes of the cope mold 34 and drag mold 36.

During this step, typically vibration is used via vibration mechanisms which shake the material to ensure that air pockets and gaps do not occur within the formed sand material of the respective molds 34, 36. It is an advantage that the lock provided by the locking pins 48 and the detent block 58 prevent slight misalignments or wandering movement of the drag flask 26 that could otherwise occur with machine vibrations thereby better ensuring for proper alignment to ensure the proper patterns and alignment of such patterns are formed into the respective cope and drag molds. In comparing FIGS. 5 and 6, it should be noted that the locking pins 48 of each pneumatic cylinder 52 has been retracted slightly into the respective barrel 54 of the pneumatic cylinder by virtue of the platen table 42 moving upwardly and projecting inwardly into the drag flask 26. It is a feature that each pneumatic cylinder 52 is set to provide a relatively low pressurized force to generally act as an air spring such that each pin resiliently engages the corresponding tapered blind hole 60 formed into the detent block 58. This can be accomplished through appropriate pressure release pneumatic controls and/or through compression of the compressible pressurized air contained within the barrels 54 of the pneumatic cylinders 52. Alternatively this also can be achieved through alternative means such as a suitable mechanical spring, other biasing mechanism and the like. In this manner, the locking pins 48 may be considered to be freely movable vertically to accommodate various relative vertical elevational changes between the drag flask 26 and the platen table 42.

Also, the force settings on the pneumatic cylinders 52 may also be set at a collective level to be less than and sufficiently less than the gravitational weight of the drag flask 26 so that when the pins are first engaged to the corresponding tapered blind holes 60 as shown when comparing FIGS. 2 and 3, that the pneumatic cylinders 52 and locking pins 48 do not lift the drag flask 26 off of the platen table 42. Proper alignment is also achieved by virtue of the cooperating tapered surfaces including the tapered end 62 of the locking pins 48 and the tapered interior surfaces of the tapered blind holes 60.

Figure 7:
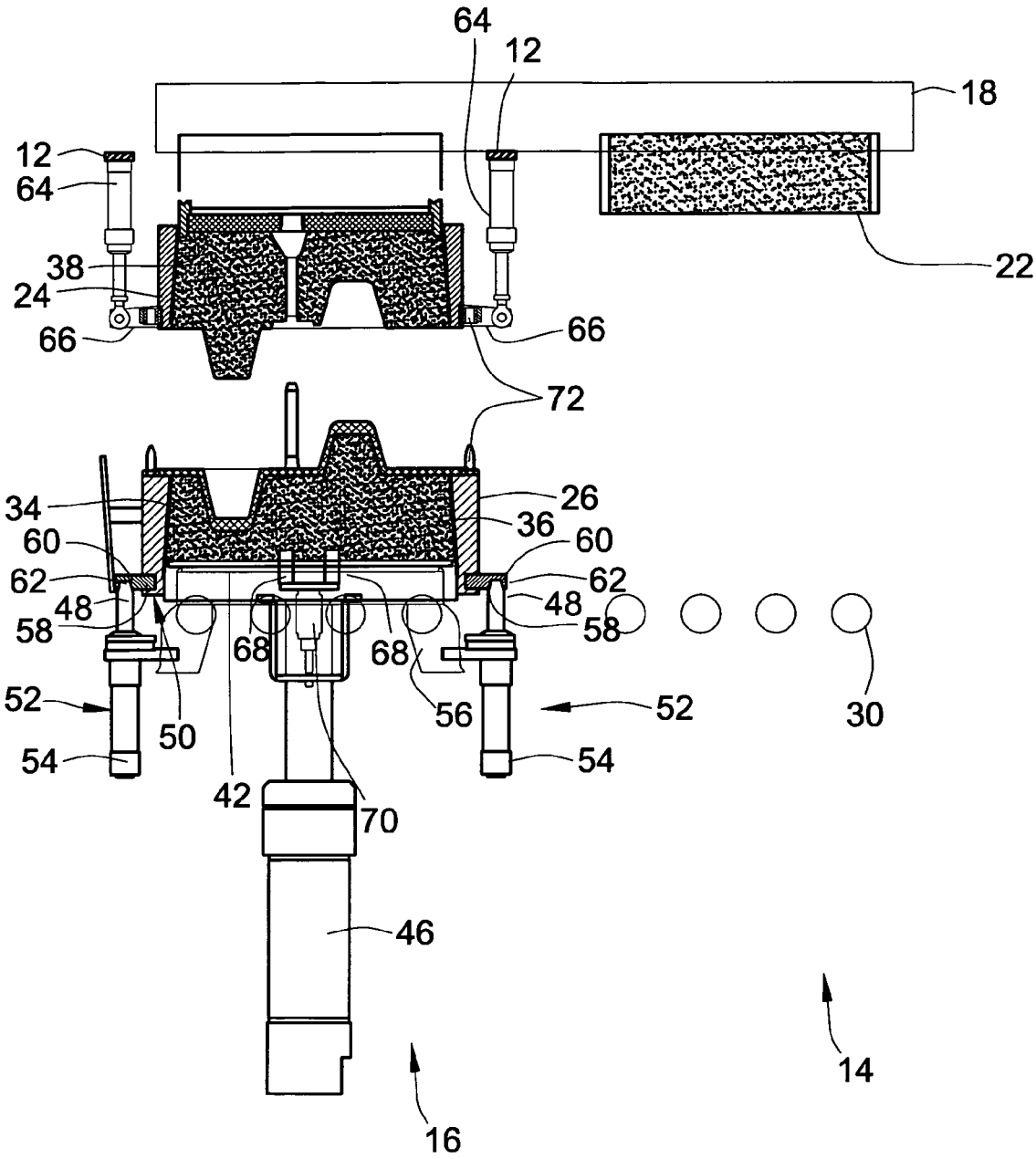
Figure 8:
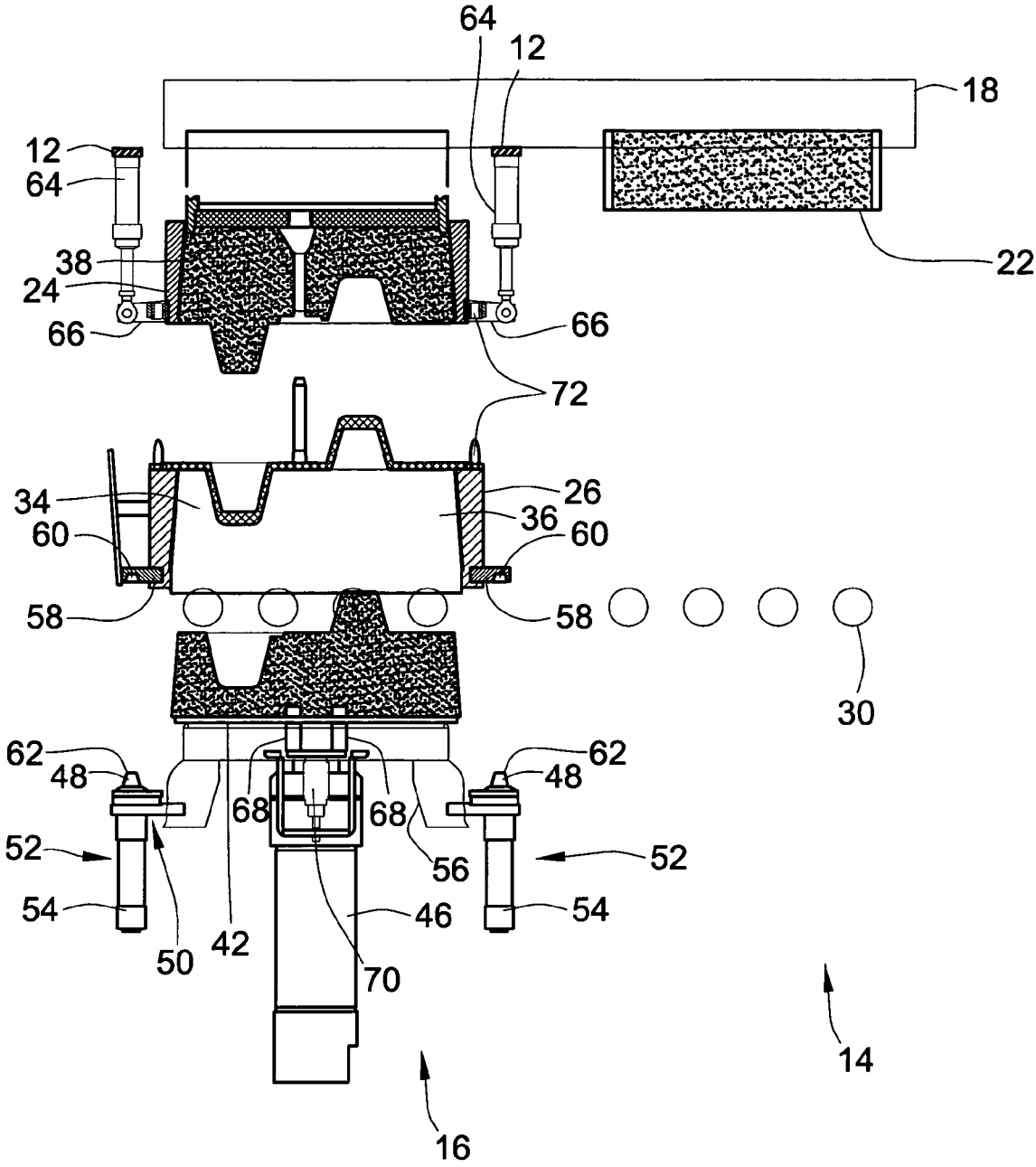

Turning back to the molding cycle, once the cope and drag molds 34, 36 have been formed and compressed, the platen hydraulic cylinder 46 lowers the platen table until the drag flask 26 rests on the outer drag flask rollers 30 as shown in FIG. 7. Due to frictional forces and compression forces, the cope mold 34 stays suspended within the cope flask 24. With the drag flask now vertically supported and retained on the drag flask rollers 30, further retraction of the platen table 42 as shown in FIG. 8 strips the drag mold 36 from the drag flask 26. This may be done utilizing the platen lock pins 68 which engage the bottom side of the drag mold 36. As shown in FIG. 8, the locking pins 48 can then be retracted and driven below the top surface of the platen table 42. At this point, the drag mold 36 rests upon the platen table 42 and the platen lock pins 68 may also be retracted.

Figure 9:
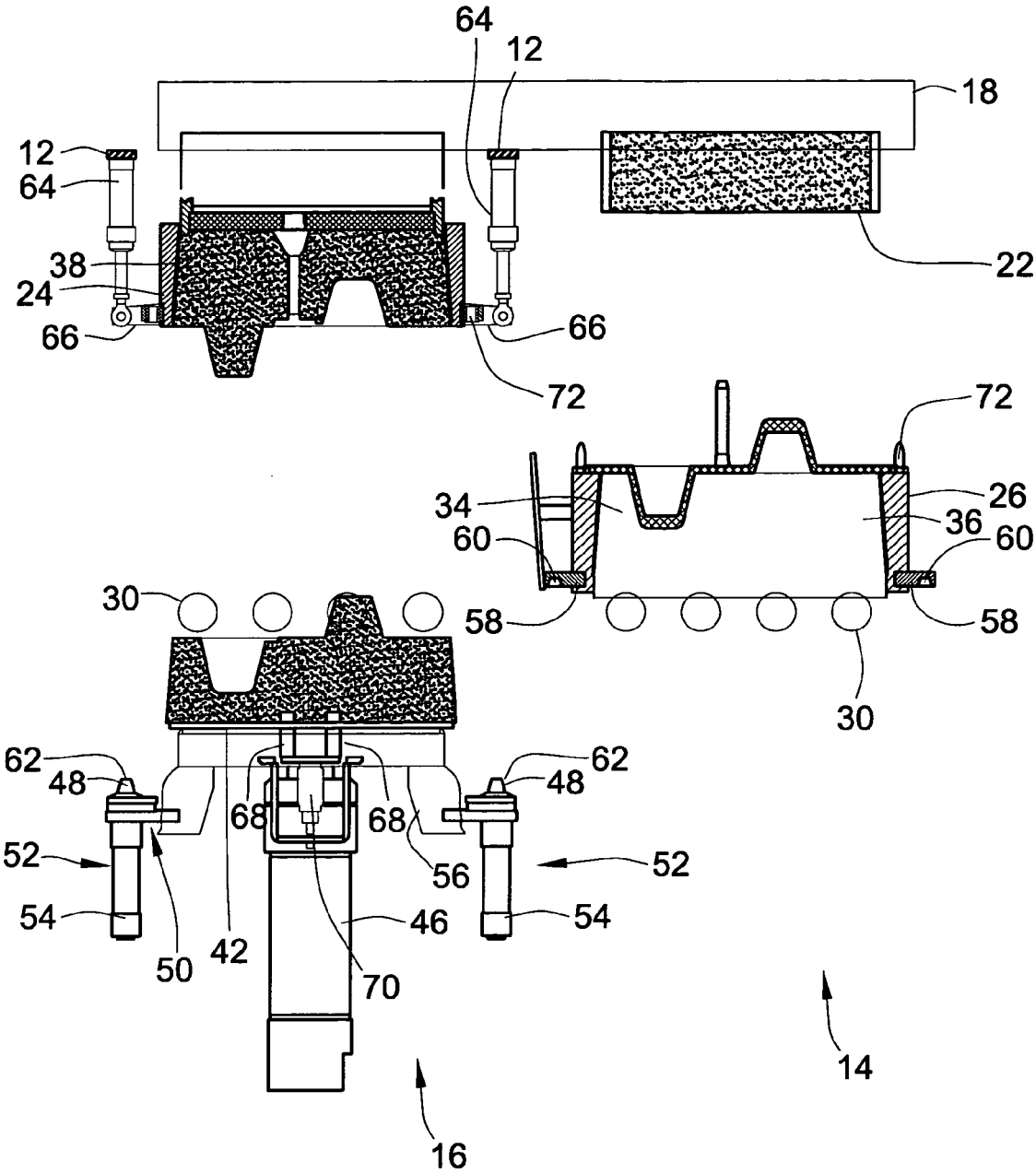

Once the drag mold is stripped from the drag flask 26 and lowered below the drag flask rollers 30, no interference exists and the drag flask 26 can then be shifted back toward the drag flask filling station where it is situated in a cradle to be rotated and again filled with sand material, as is shown in FIG. 9.

Figure 10:
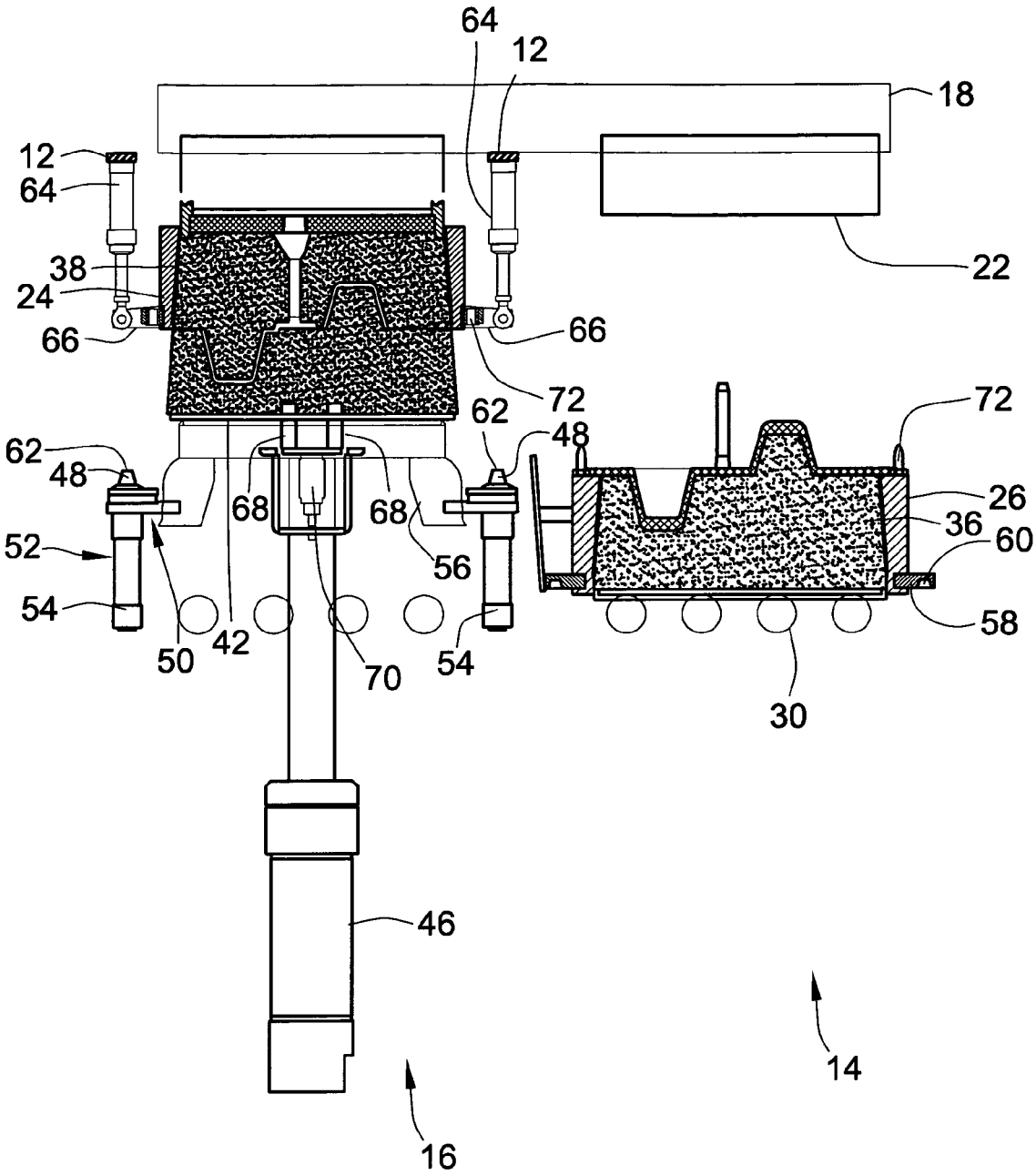
Figure 11:
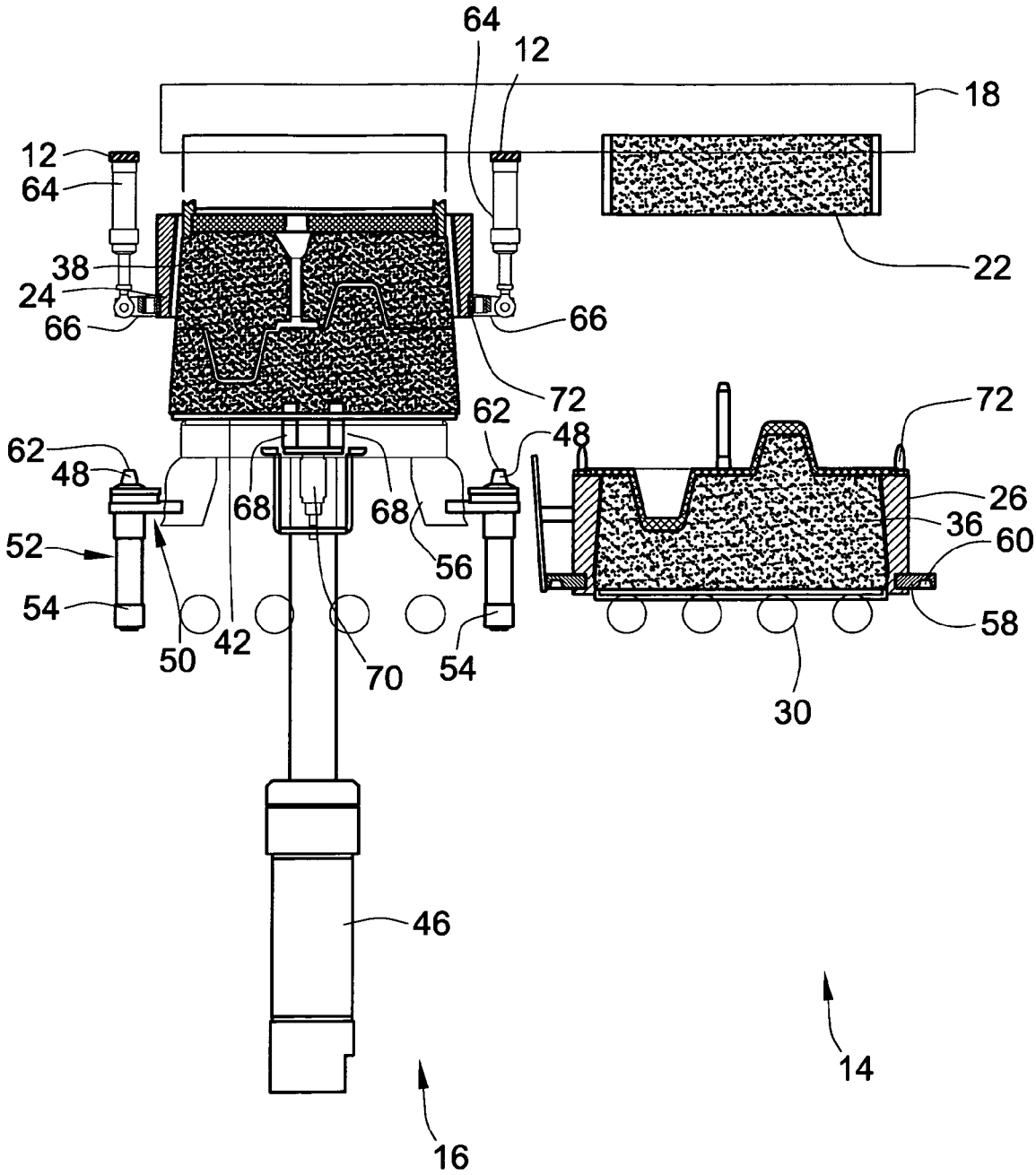
Figure 12:
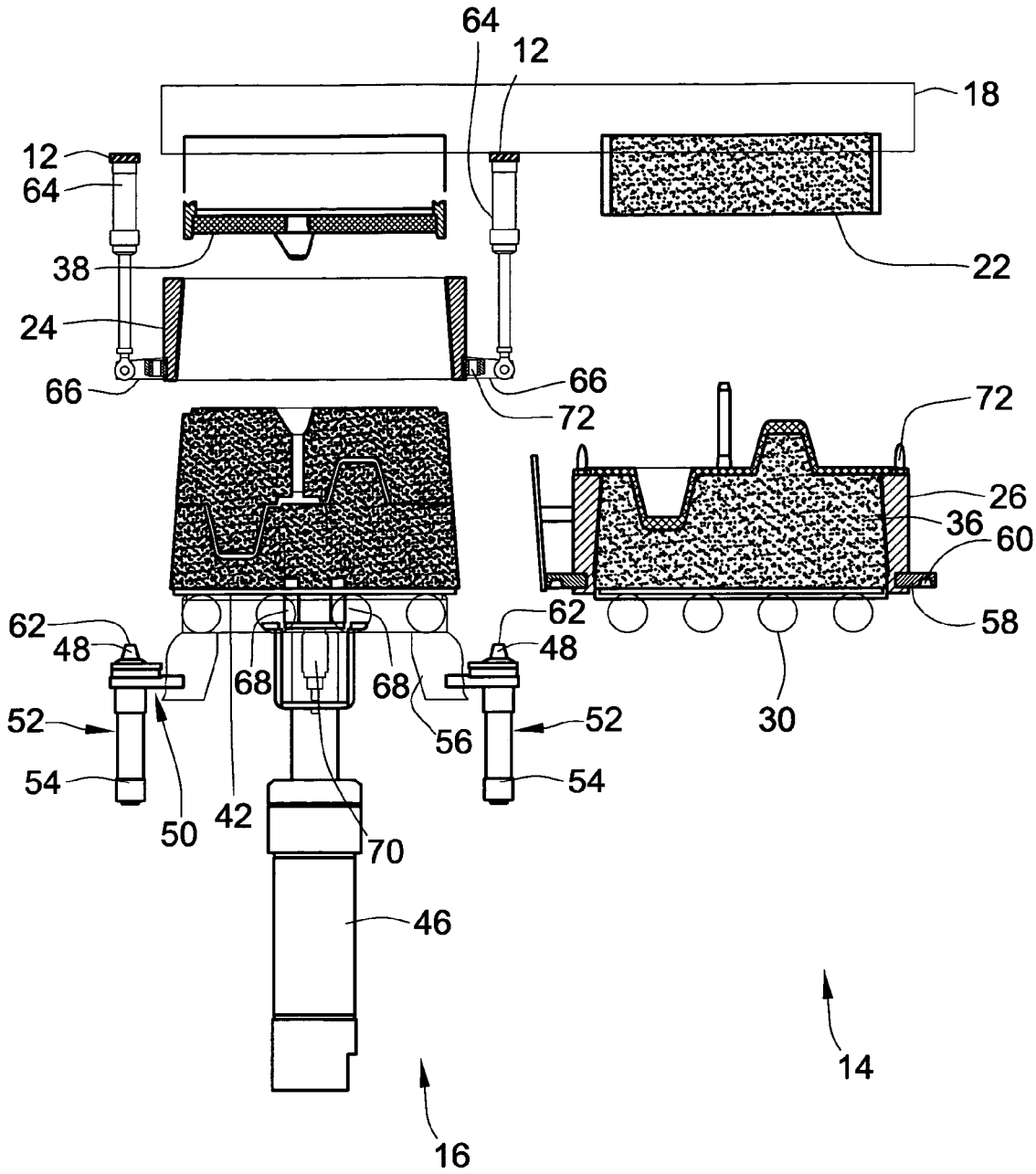

Turing to FIG. 10, the drag mold 36 is raised on the platen table 42 into engagement with the cope mold 34. At this point and in accordance with a further aspect of this embodiment of the present invention, with reference to FIG. 11, the cope flask cylinders 64 are actuated to lift the cope flask 24 relative to the squeeze head 38 and thereby pop and strip the cope flask 24 from the cope mold 34. The cope mold 34 is opposed by the squeeze head causing it to rest in a stationary position upon the drag mold 36. It is an advantage that there is no need to pull the cope flask apart or otherwise vertically drive the squeeze head downward. Instead, the squeeze head 38 may be kept stationary in the vertical dimension to achieve release of the cope mold. With the cope mold 34 released from the cope flask 24, the now formed mold with the cope mold 34 resting upon the drag mold 36 can be lowered on the platen table 42 via the platen hydraulic cylinder to an elevation where it is suitable to be output to downstream mold handling equipment, as is shown in FIG. 12.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A molding machine, comprising:

a cope flask for making cope molds;

a drag flask for making drag molds;

a pattern plate positioned between the cope flask and the drag flask in a squeeze position;

a squeeze head positionable into an open end of the cope flask in the squeeze position with the cope flask extending generally between the squeeze head and the pattern plate;

a platen table positionable into at an open end of the drag flask in the squeeze position with the drag flask extending generally between the platen table and the pattern plate; and said platen table and drag flask defining an interengageable lock including a pin and a recess member that are positionable into a locking position as an incident to positioning of said platen table into the open end of said drive flask for preventing relative lateral movement between the platen table and the drag flask in the squeeze position.

2. The molding machine of claim 1, wherein the lock comprises at least two actuators in spaced lateral relation mounted to the platen table, and at least two detent structures integral with the drag flask, each actuator having a pin that is linearly movable into engagement and out of engagement with a corresponding one of the detent structures.

3. The molding machine of claim 2, wherein each detent structure comprises a hole, the pin of each actuator being movable into and out of the corresponding one of the holes.

4. The molding machine of claim 3, wherein each hole comprises a tapered blind hole complimentary with a tapered end of the pins of one of the actuators.

5. The molding machine of claim 4, wherein each actuator comprises a fluid cylinder, and each fluid cylinder has a pressurized state resiliently urging the pin of such actuator against the corresponding one of the detent structures such that during relative movement between the platen table and the drag flask toward and away from each other, the pins retract and extend from the fluid cylinder to accommodate said relative movement.

6. The molding machine of claim 5, wherein the cope flask, the drag flask and the pattern plate are assembled in a vertical orientation in the squeeze position with the squeeze head and the platen table in vertical opposition for squeezing movement into the cope flask and drag flask respectively, and wherein the gravitational weight of the drag flask is sufficient to cause the pins to retract from an extended position into the corresponding ones of the fluid cylinders against fluid power exerted thereby.

7. The molding machine of claim 1, wherein the molding machine comprises a squeeze station having the cope flask located therein and a drag mold filling station horizontally adjacent the squeeze station, the drag mold filling station including a rotary cradle adapted to rotate the drag flask to facilitate sand filling of the drag flask, the drag flask being cyclically shifted back and forth between the squeeze station and the drag mold filling station during operation of the molding machine, and a hopper car having a sand hopper with a sand discharge outlet, the hopper car shifting horizontally between the squeeze station for filling the cope flask with sand and the drag mold filling station for filling the drag flask with sand.

8. The molding machine of claim 1, further comprising platen lock pins projecting from the platen table and into a cavity internal to the drag flask in the squeeze position for engaging the drag mold, and wherein the lock between the platen table and the drag flask is external to the drag flask.

9. The molding machine of claim 1, wherein the lock comprises cooperating members separately mounted to the drag flask and the platen including a pin and a detent member, the pin being movable into and out of the detent member.

10. The molding machine of claim 9, further comprising means for biasing the pin.

11. The molding machine of claim 10, wherein the biasing means comprises a pneumatic cylinder, further comprising a mounting bracket securing the pneumatic cylinder to the platen table, the mounting bracket projecting laterally outside an outer periphery of the platen table to offset the pin laterally from the table.

12. The molding machine of claim 9, wherein the pin is carried by the platen table and laterally spaced relative to a mold support surface of the table, and wherein the detent member is integral with the drag flask and includes a hole that slidably and removably receives the pin.

13. The molding machine of claim 12 wherein the pin includes a tapered end and wherein the hole is a tapered blind hole.

14. The molding machine of claim 9, wherein the lock is arranged external to the drag flask.

* * * * *